US006075196A

United States Patent [19]

Fujiwara et al.

[11] Patent Number: 6,075,196

[45] Date of Patent: Jun. 13, 2000

[54] PLAYER PIANO REPRODUCING SPECIAL PERFORMANCE TECHNIQUES USING INFORMATION BASED ON MUSICAL INSTRUMENTAL DIGITAL INTERFACE STANDARDS

[75] Inventors: Yuji Fujiwara; Takashi Tamaki; Yasuhiko Oba; Taro Kawabata, all of Hamamatsu, Japan

[73] Assignee: Yamaha Corporation, Hamamatsu, Japan

[21] Appl. No.: 09/026,847

[22] Filed: Feb. 20, 1998

[30] Foreign Application Priority Data

Feb. 25, 1997 [JP] Japan ..... 9-041226

[51] Int. Cl.[7] ..... G10H 7/00

[52] U.S. Cl. ..... 84/645; 84/13

[58] Field of Search ..... 84/645, 13

[56] References Cited

U.S. PATENT DOCUMENTS 5,083,491 1/1992 Fields .
5,731,530 3/1998 Fujiwara et al. .

FOREIGN PATENT DOCUMENTS 7-175472 7/1995 Japan .

*Primary Examiner*—Jeffrey Donels
*Attorney, Agent, or Firm*—Graham & James LLP

[57] ABSTRACT

A brand-new player piano is designed to have a compatibility with the conventional player piano and the electronic musical instrument based on the MIDI standard while providing a capability of playing a highly skilled music performance such as the performance technique of half stroke. The player piano creates a new version of performance information which uses a key-depression event frame in addition to a string-striking event frame and a key-release event frame. Herein, the string-striking event frame contains extensional information for a string-striking velocity, while the key-release event frame contains extensional information for a key-release velocity. The extensional information is not specifically defined by the MIDI standard and is neglected by the conventional player piano. The key-depression event frame, which is newly introduced by this player piano and is neglected by the conventional player piano, represents a note number and a key-depression velocity as well as extensional information for the key-depression velocity. Using the extensional information, it is possible to control each of the velocities more precisely. The performance information is recorded on a recording media. At a reproduction, the player piano produces trajectory data and position data with respect to each of the keys on the basis of the performance information. The trajectory data represent a key-depression-uniform-motion trajectory and a key-depression-slow-down trajectory along which a key moves when being depressed. The trajectory data also represent a key-release-uniform-motion trajectory and a key-release-slow-up trajectory along which the key moves when being released.

8 Claims, 11 Drawing Sheets

| | FIRST BYTE | SECOND BYTE | THIRD BYTE |
|---|---|---|---|
| STRING-STRIKING EVENT | 10010000 | 0kkkkkkk | 0vvvvvvv [90 kk vv] |
| EXTENSIONAL BYTES | 10110000 | 00010000 | 0wwwrrrr [B0 10 wr] |
| or | 10110000 | 00010000 | 0wwwwwww [B0 10 ww] |

FIG.2

| | FIRST BYTE | SECOND BYTE | THIRD BYTE |
|---|---|---|---|
| NOTE NUMBER DESIGNATOR | 10110000 | 01010000 | 0kkkkkkk [B0 50 kk] |
| KEY-DEPRESSION EVENT | 10110000 | 01010001 | 0vvvvvvv [B0 51 vv] |
| EXTENSIONAL BYTES | 10110000 | 00010000 | 0wwwrrrr [B0 10 wr] |

FIG.3

| | FIRST BYTE | SECOND BYTE | THIRD BYTE |
|---|---|---|---|
| KEY-RELEASE EVENT | 100000000 | 0kkkkkkk | 0vvvvvvv [80 kk vv] |
| EXTENSIONAL BYTES | 10110000 | 0010000 | 0wwwrrrr [B0 10 wr] |

FIG.4

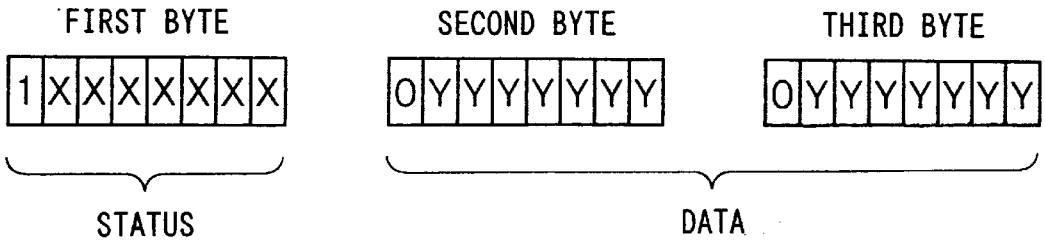
FIG.13
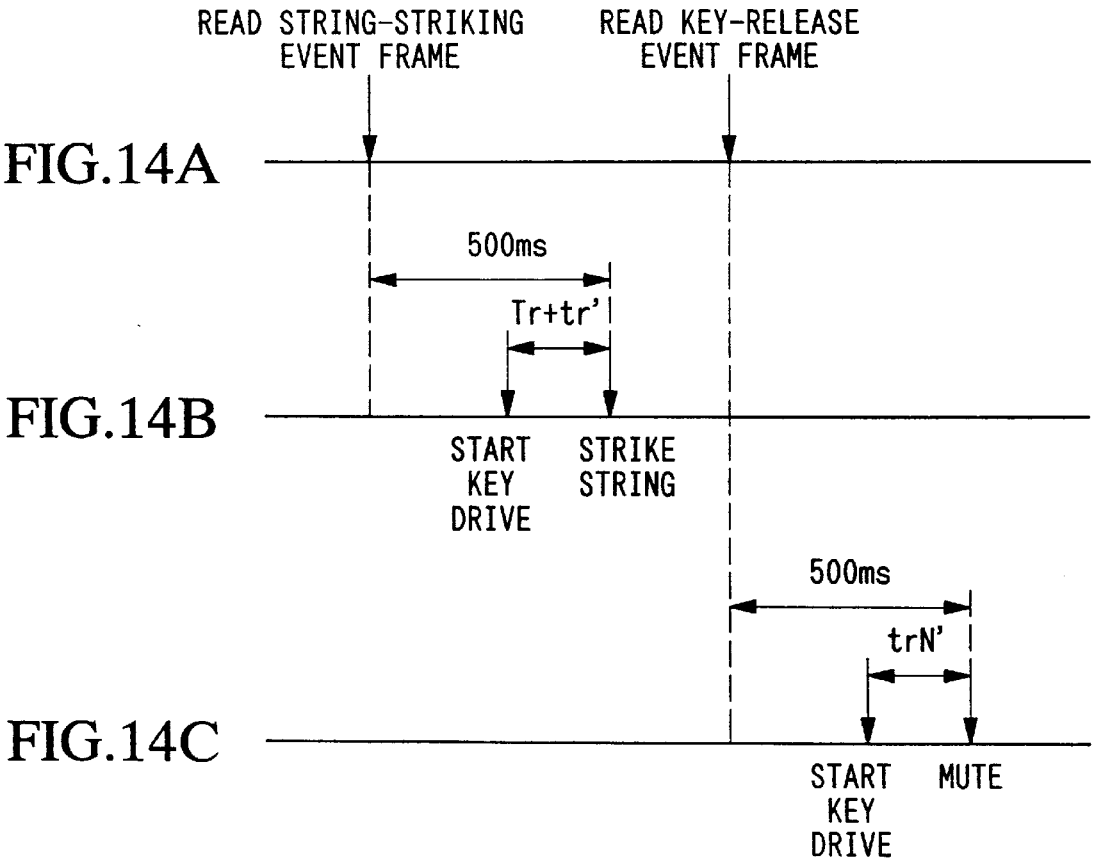

PLAYER PIANO REPRODUCING SPECIAL PERFORMANCE TECHNIQUES USING INFORMATION BASED ON MUSICAL INSTRUMENTAL DIGITAL INTERFACE STANDARDS

BACKGROUND OF THE INVENTION

1. Field of the Invention

This invention relates to player pianos which produce musical tones in response to performance information based on MIDI standard.

2. Prior Art

In the player piano, when a performer (i.e., a human operator who plays the player piano) depresses a key, a damper leaves a string while a hammer rotates to strike the string, so that a musical tone is produced. On the other hand, when the performer engages a key release operation, the damper comes in contact with the string, so that the musical tone is subjected to muting. As described above, generation of the musical tone is performed normally in accordance with a series of operations, as follows:

Key depression→string striking→key release→muting.

At a recording mode, performance information is created based on the aforementioned operations and is recorded. At a reproduction mode, the performance information is read and is used to control a motion of a key. When controlling the motion of the key, a solenoid is excited based on the performance information so that the key is driven. Thus, the hammer rotates to strike the string.

In the field of the electronic musical instruments, "MIDI" (an abbreviation for "Musical Instrument Digital Interface") is known as the interface for transmission of performance information in a form of digital signals. Herein, a MIDI message is represented by serial data whose unit corresponds to one byte consisting of eight bits. The MIDI message is configured by data and a status which designates a kind of the message. The status corresponds to "note-on" representing key depression or "note-off" representing key release.

The performance information of the player piano is normally based on the MIDI standard. An action of the player piano is represented by one MIDI message called an event. So, the performance information is configured by multiple events. A series of operations (or actions), which are expressed as "key depression→string striking→key release→muting", are normally represented using a string-striking event which designates an event that a hammer strikes a string and a key-release event which designates an event that a damper comes in contact with a string. Herein, the string-striking event corresponds to note-on while the key-release event corresponds to note-off.

One event is represented by three bytes as shown in FIG. 13. Namely, one event is configured by a status represented by one byte and data represented by two bytes. '0' is written at a top bit (i.e., first bit) of each of the two bytes representing the data in order to provide distinction between the status and data. A note number which designates a musical scale (or a pitch) is written at a first byte of the data following the status. In addition, velocity information representing a velocity of a key is written at a second byte of the data. Since a first bit of the second byte of the data is automatically set at '0', remaining seven bits are used to represent the velocity of the key.

Among performance techniques of the pianos, there is provided a special performance technique called "half stroke". In the case of the half stroke, a key release is started before completion of a key depression, in other words, a key release is started before a key is completely depressed to its end position. Or, a next key depression is started in the middle of execution of the key release.

However, the conventional player pianos are not designed in consideration of reproduction of the half stroke that the key depression or key release is performed in a halfway manner. In other words, it is difficult to sufficiently reproduce the half stroke using only the string-striking event and key-release event. The paper of Japanese Patent Laid-Open Publication No. 7-175472 describes the technology for accurate reproduction of the string-striking speed in the player piano, wherein a variety of variations are made with respect to the key depressing operations. Actually, however, it is difficult to bring such a variety of variations on the key depressing operations of the player piano. So, it is possible to provide a proposal that additional information is newly introduced to cope with the variation-type performance such as the half stroke.

However, using the additional information causes several problems. That is, if a status other than the aforementioned status used for representation of the note-on/off is set for discrimination of the additional information, it is impossible to maintain compatibility with respect to the MIDI message.

In the conventional player piano, string-striking information and key-release information corresponding to the note-on and note-off based on the MIDI standard are each represented by seven bits. In the actual performance of the piano, a great change occurs on the velocity of the key in a process of transition from pianissimo to fortissimo. For this reason, the velocity of the key cannot be represented by one byte in some case. In such a case, it is necessary to provide an extension for key velocity information. However, if such an extended information is simply set to a status other than the status used for representation of the note-on/off, the player piano suffers from problems like the aforementioned problems regarding the additional information.

SUMMARY OF THE INVENTION

It is an object of the invention to provide a player piano which is capable of providing advanced performance while maintaining compatibility in MIDI standard by extending performance information.

The player piano of this invention creates a new version of performance information which uses a key-depression event frame in addition to a string-striking event frame and a key-release event frame. Herein, the string-striking event frame represents a musical scale (or a pitch) and a string-striking velocity as well as extensional information for the string-striking velocity. The key-release event frame represents a musical scale (or a pitch) and a key-release velocity as well as extensional information for the key-release velocity. Herein, the extensional information is not specifically defined by the MIDI standard and is neglected by the conventional player piano. The key-depression event frame, which is newly introduced by this player piano and is neglected by the conventional player piano, represents a note number and a key-depression velocity as well as extensional information for the key-depression velocity. Using the extensional information as well as the key-depression event frame, it is possible to control each of the velocities more precisely. The performance information is recorded on a recording media.

At a reproduction, the player piano produces trajectory data and position data with respect to each of the keys on the basis of the performance information. The trajectory data represent a key-depression-uniform-motion trajectory and a key-depression-slow-down trajectory along which a key moves when being depressed. The trajectory data also represent a key-release-uniform-motion trajectory and a key-release-slow-up trajectory along which the key moves when being released. The key-depression-slow-down trajectory and key-release-slow-up trajectory cross each other at a cross time at which a key velocity is zero.

BRIEF DESCRIPTION OF THE DRAWINGS

These and other objects of the subject invention will become more fully apparent as the following description is read in light of the attached drawings wherein:

FIG. 2 shows an example of a data format for a string-striking event frame;

FIG. 3 shows an example of a data format for a key-depression event frame;

FIG. 4 shows an example of a data format for a key-release event frame;

FIG. 13 shows an example of a configuration of a MIDI message; and

FIG. 14A, FIG. 14B and FIG. 14C are time charts showing a relationship between the timing to read a string-striking event frame and the timing to strike a string as well as a relationship between the timing to read a key-release event frame and the timing of a key release.

DESCRIPTION OF THE PREFERRED EMBODIMENT

Now, a description will be given with respect to the preferred embodiment of the invention with reference to the drawings.

[A] Configuration

Figure 1:
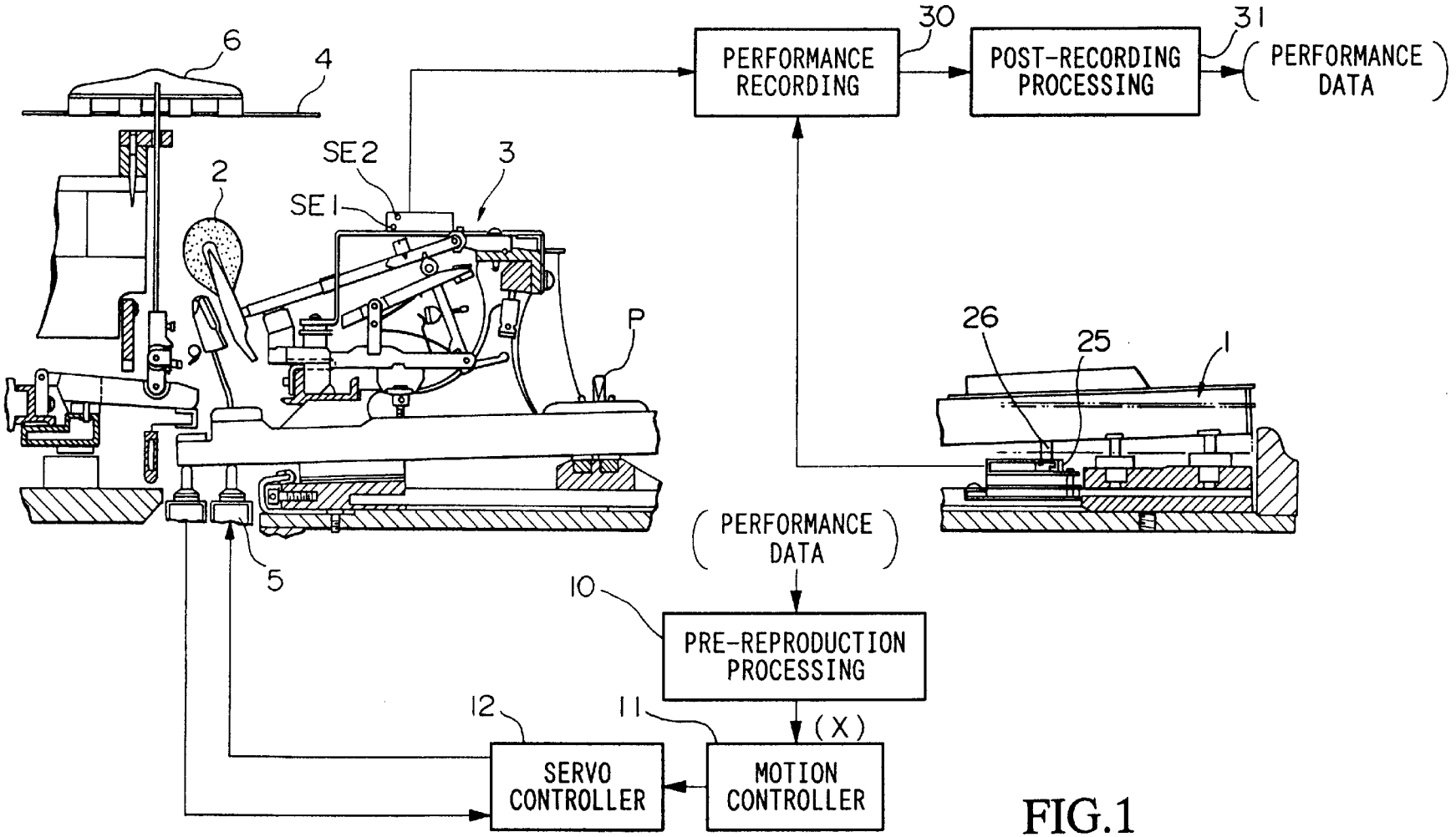
FIG. 1 is a block diagram showing a configuration of a player piano in accordance with the embodiment of the invention.

FIG. 1 is a block diagram with regard to a player piano in accordance with the embodiment of the invention. Specifically, FIG. 1 shows an example of construction of mechanical parts of the player piano as well as an example of configuration of electronic parts of the player piano.

In FIG. 1, a motion of a key 1 is transmitted to a hammer 2 by means of an action mechanism 3. The hammer 2 strikes a string 4, while the key 1 is driven by a solenoid 5. When a plunger of the solenoid 5 projects upwardly, the key 1 rotates about a balance pin P. Then, a moving end of the key 1 is lowered in elevation at a performer side. This state is called a key-depression state. Responding to such a key-depression state, the action mechanism 3 operates so that a damper 6 leaves from the string 4 while the hammer 2 rotates to strike the string 4. When a performer plays the player piano, his or her finger depresses the key 1. Thus, the action mechanism 3 operates as described above, so that the hammer 2 strikes the string 4.

Sensors SE1 and SE2 are attached to the action mechanism 3 with a certain gap therebetween to measure a string-striking velocity. By measuring a period of time that the hammer 2 passes through the gap between the sensors SE1 and SE2, a performance recording unit 30 measures a velocity of the hammer 2, i.e., a string-striking velocity (or tone-generation velocity). In addition, the performance recording unit 30 detects the timing that the hammer 2 passes the sensor SE2 as a string-striking time (or tone-generation time).

A shutter 26 having a plate-like shape is attached to a lower surface of the key 1. A key sensor 25 is configured by two pairs of photo-sensors SF2 and SF3, which are located at different elevations with a certain distance beneath the key 1. Herein, a pair of photo-sensors "SF2" (simply called "photo-sensor SF2") are located at an upper position while a pair of photo-sensors "SF3" (simply called "photo-sensor SF3") are located at a lower position. In a depression process of the key 1, the upper photo-sensor SF2 is shut off at first, in other words, the shutter 26 shuts out light of the upper photo-sensor SF2 at first. Then, the lower photo-sensor SF3 is shut off. In a release process of the key 1, the lower photo-sensor SF3 is released from a light-shut-out state at first, in other words, the photo-sensor SF3 is restored to a light-receiving state at first. Then, the upper photo-sensor SF2 is restored to a light-receiving state.

Output signals of the key sensor 25 are supplied to the performance recording unit 30. At a key depression, the performance recording unit 30 measures a period of time between a first time instant that the upper photo-sensor SF2 is placed in a light-shut-out state and a second time instant that the lower photo-sensor SF3 is placed in a light-shut-out state. Based on the measured period of time, the performance recording unit 30 detects a key-depression velocity Vk. In addition, the performance recording unit 30 detects the timing that the lower photo-sensor SF3 is just placed in a light-shut-out state as a key-depression time tk.

At a key release, the performance recording unit 30 measures a period of time between a first time instant that the lower photo-sensor SF3 is placed in a light-receiving state and a second time instant that the upper photo-sensor SF2 is placed in a light-receiving state. Based on the measured period of time, the performance recording unit 30 detects a key-release velocity VkN. In addition, the performance recording unit 30 detects the timing that the upper photo-sensor SF2 is just placed in a light-receiving state as a key-release time tkN.

Next, a post-recording process unit 31 effects a normalization process on various kinds of information given from the performance recording unit 30. Thus, the information is converted in a prescribed data format and is supplied to an external recording media as performance information. The normalization process is effected to absorb an individual difference between pianos. Parameters such as the string-striking time, key-depression time, key-depression velocity, key-release time and key-release velocity depend on the positions of sensors of the piano and structural difference of the piano as well as the mechanical error of the piano. In other words, each piano may have a specific tendency in variations of the above parameters. The normalization process is made by providing an assumption of the "standard" piano. So, actually measured parameters which are actually measured on the existing piano are converted to those such as the string-striking time and string-striking velocity which are suited to the "assumed" standard piano.

A pre-reproduction processing unit 10 produces trajectory data of the key (representing an trajectory or a path along which a moving end of the key moves) based on performance data given from the recording media or performance data supplied from a real-time communication device (not shown). In addition, the pre-reproduction processing unit 10 uses the trajectory data of the key to produce position data (t, X) of the key. The position data (t, X) produced by the pre-reproduction processing unit 10 are supplied to a motion controller 11. The motion controller 11 produces position control data (X) based on the position data (t, X). Herein, the position control data (X) correspond to a position of the key at each moment. The position control data (X) are supplied to a servo controller 12.

The servo controller 12 supplies a solenoid 5 with the exciting current corresponding to the position control data (X). In addition, the servo controller 12 compares a feedback signal given from the solenoid 5 with the position control data (X). Thus, the servo controller 12 performs a servo control in such a way that the feedback signal coincides with the position control data (X).

[B] Performance information

Next, a description will be given with respect to performance information which is produced by the post-recording processing unit 31. FIG. 2 shows an example of a data format of the performance information. The performance information is produced with respect to a unit of operation which coincides with each of operations corresponding to key depression, string-striking and key release. So, one operation unit is called an event.

Performance data corresponding to a tune to be played are represented by a combination of events. In order to reproduce the trajectory of the movement of the key at a reproduction mode of the player piano, it is necessary to specify the timing of occurrence of an event (hereinafter, referred to as an event time). For this reason, the performance data of the tune are configured by inserting interval data, representing a time difference in occurrence between events, into event data.

(1) String-striking event frame

A string-striking event is produced when the hammer 2 passes the sensor SE1. An event time of the string-striking event corresponds to a string-striking time at which the hammer 2 passes the sensor SE1.

FIG. 2 shows a data format for representation of a string-striking event frame. The string-striking event frame is configured by a string-striking event and extensional bytes. The string-striking event consists of multiple bytes, a first one of which represents a status. A data value of "90" is set to the first byte to provide representation of a string-striking event. Herein, "9" corresponds to a hexadecimal number of high-order four bits of the first byte, while "0" corresponds to a hexadecimal number of low-order four bits of the first byte. In addition, a digit "0" is written at first bits of the second and third bytes of the string-striking event. Using such a digit "0", it is possible to provide distinction between the status and other bytes which correspond to data of the string-striking event. In the second byte, "kkkkkkk" correspond to seven bits representing a note number, by which a musical scale (or a pitch) is designated. In the third byte, "vvvvvvv" correspond to seven bits representing a string-striking velocity. The conventional player piano is designed to produce the above string-striking event as well.

The extensional bytes consist of multiple bytes, wherein first and second bytes represent a status having a data value of "B0 10". Herein, "B0" corresponds to the first byte while "10" corresponds to the second byte. Two types of a third byte are provided for the extensional bytes. Herein, "www" of the third byte correspond to low-order three bits of the string-striking velocity, while "wwwwwww" of the third byte correspond to low-order seven bits of the string-striking velocity. Incidentally, the status "B1 10" used for the extensional bytes is defined as a "general purpose controller" in the MIDI standard. The general purpose controller is a kind of an interface conforming with a format of a MIDI message based on the MIDI standard, however, its content is not specifically defined by the MIDI standard. For this reason, the general electronic musical instruments neglect the general purpose controller of the MIDI standard.

In the conventional player piano, performance information is configured using events corresponding to note-on and note-off. So, if an event of a status defined by the general purpose controller is input to the player piano, it is neglected. Therefore, if the conventional player piano reproduces the string-striking event frame added with the extensional bytes, the extensional bytes are neglected, so the key is driven based on the string-striking event only. In this case, data of the string-striking event represent high-order seven bits of the string-striking velocity. So, it is possible to drive the key with a precision similar to a precision of the performance information recorded by the conventional player piano. In contrast to the conventional player piano, if the player piano of the present embodiment reproduces the string-striking event frame added with the extensional bytes, it detects the status of the extensional bytes. So, the player piano of the present embodiment inputs data following the status of the extensional bytes as extended data. Thus, it is possible to reproduce a velocity of a key at a string-striking time with a good precision.

(2) Key-depression event frame

A key-depression event is produced based on a fact that in response to depression of the key 1, the upper photo-sensor SF2 is shut off, then, the lower photo-sensor SF3 is shut off. An event time of the key-depression event corresponds to a key-depression time tk at which the key 1 passes the lower photo-sensor SF3.

FIG. 3 shows a data format for the key-depression event. A note number designator is written at a first place of a key-depression event frame. The note-number designator consists of multiple bytes, wherein first and second bytes represent a status. A data value of "B0 50" is set to the first and second bytes to provide representation of the note number designator. In addition, a series of bits "kkkkkkk" are written as low-order seven bits of a third byte of the note number designator to designate a note number. The aforementioned status of the note number designator corresponding to the data value of "B0 50" is defined as a general purpose controller in the MIDI standard. Incidentally, it is possible to omit the note number designator from the key-depression event frame. If the note number designator is omitted, a reproduction system of the player piano employs a note number which is determined in advance. Suppose an example that the aforementioned string-striking event represented by "90 kk vv" is followed by the key-depression event, wherein the note number designator is omitted from the key-depression event frame. In such an example, the note number "kk" is designated by the string-striking event and is retained in the key-depression event frame as well. Incidentally, the note number designator can be changed to conform with "A0 kk 1C", for example.

Next, a key-depression event is written to follow the note number designator. The key-depression event consists of multiple bytes, wherein first and second bytes represent a status. A data value of "B0 51" is set to the first and second bytes to provide representation of the key-depression event. In addition, a series of bits "vvvvvvv" are written at low-order seven bits of a third byte of the key-depression event so as to designate high-order seven bits of the key-depression velocity. Incidentally, the status of the key-depression event having the data value of "B0 51" is defined as a general purpose controller in the MIDI standard.

Next, extensional bytes are written to follow the key-depression event. Like the aforementioned string-striking event frame, the extensional bytes of the key-depression event frame consist of multiple bytes, wherein first and second bytes represent a status. A data value of "B0 10" is set to the first and second bytes to provide representation of the extensional bytes. A series of bits "www" of a third byte of the extensional bytes represent low-order three bits of the key-depression velocity.

Using the key-depression event frame, it is possible to reproduce the key-depression velocity. Thus, it is possible to enable performance using the half stroke and the like by an accurate reproduction of the trajectory in movement of the key (simply referred to as key-movement trajectory), which will be described later.

(3) Key-release event frame

A key-release event is produced based on a fact that in response to release of the depressed key 1, the lower photo-sensor SF3 is firstly placed in a light-receiving state, then, the upper photo-sensor SF2 is placed in a light-receiving state. An event time of the key-release event corresponds to a key-release time tkN at which the key moves upwardly to pass the upper photo-sensor SF2.

FIG. 4 shows an example of a data format for a key-release event frame. The key-release event frame is configured by a key-release event and extensional bytes. The key-release event consists of multiple bytes, a first type of which represents a status. A data value of "80" is set to the first byte to provide representation of the key-release event. In addition, a digit "0" is written at a first bit of a second byte and a first bit of a third byte respectively. Thus, it is possible to provide a distinction between the status and data. A series of bits "kkkkkkk" of the second byte represent a note number using seven bits, by which a musical scale (or a pitch) is designated. Further, a series of bits "vvvvvvv" of the third byte represent high-order seven bits of a key-release velocity. In accordance with the above procedures, the key-release event is produced for the conventional player piano as well.

In the extensional bytes, first and second bytes represent a status. A data value of "B0 10" is set to the first and second bytes to provide representation of the extensional bytes. A series of bits "www" of a third byte represent low-order three bits (or low-order seven bits) of the key-release velocity. Incidentally, the status of the extensional bytes having the data value of "B0 10" is defined as a general purpose controller in the MIDI standard.

(4) Order for production of event frames

In response to one key-depression-and-key-release operation applied to one key, the aforementioned event frames are sequentially produced frequently in an order, as follows:

Key-depression event frame→string-striking event frame→key-release event frame.

In the actual performance, however, the event frames are sequentially produced in an order of string-striking event frame→key-depression event frame→key-release event frame, or in an order of key-depression event frame→key-release event frame→string-striking event frame.

In addition, a time interval is inserted between the event frames. For this reason, the event frames together with the time intervals are written at consecutive addresses on the recording media. In the transmission, each of the frames is transmitted with an interval of time corresponding to the time interval.

As described above, the player piano of the present embodiment uses a specific type of the key-depression event frame which is not used in the conventional player piano, wherein the key-depression event is written on the recording media to precede or follow the string-striking event frame. However, the player piano of the present embodiment is capable of maintaining the compatibility with the conventional player piano.

As described before, the status of the key-depression event frame is defined as a general purpose controller in the MIDI standard, so it is neglected in the conventional player piano. Suppose a situation where frames are sequentially produced in an order as follows:

Key-depression event frame→string-striking event frame→key-release event frame.

In such a situation, the conventional player piano reproduces two frames in a consecutive manner as follows:

String-striking event frame→key-release event frame.

The conventional player piano repeats the above manner of reproduction as well in a situation where frames are sequentially produced in an order as follows:

String-striking event frame→key-depression event frame→key-release event frame.

Because the conventional player piano performs the same manner of reproduction with respect to the foregoing frames in each of the above situations, the player piano of the present embodiment is capable of maintaining the compatibility with the conventional player piano.

(5) Arrangement of extensional bytes

As described heretofore, when using the extensional bytes with respect to each event frame, the extensional bytes are arranged just after the event which requires extension. Reasons will be described below.

In the reproduction system of the player piano, low-order bits designated by the extensional bytes are coupled to high-order bits designated by the event to provide detection of the velocity data, based on which a key-movement trajectory is reproduced. However, if the extensional bytes and the event are separate from each other with respect to time, a long time is required to obtain the velocity data. In that case, it is necessary to reproduce the key-movement trajectory in a short period of time. For this reason, the extensional bytes are arranged just after the event, so that the velocity data can be obtained in a short period of time. Thus, a room is provided for reproduction of the key-movement trajectory with respect to time. If another event is inserted between the event and its extensional bytes, there occurs an error in specification of the event which is extended by the extensional bytes. To avoid such an error, the extensional bytes are arranged just after the event.

[C] Principle in creation of key-movement trajectory

Next, a description will be given with respect to the principle in creation of the key-movement trajectory by the pre-reproduction processing unit 10.

(1) Reference point

Normally, the string-striking velocity of the hammer 2 depends on the depressing velocity of the key 1. In some case, the depressing velocity of the key 1 changes in a manner that the velocity is slow at first but is increased faster gradually. Or, the depressing velocity of the key 1 changes in a manner reverse to the above manner. Or, the depressing velocity of the key 1 is maintained almost constant. Anyway, it is important to study the relationship between the string-striking velocity of the hammer 2 and the depressing velocity by which the key 1 moves from a rest position to an end position. Because, even if the key velocity (or its initial velocity) is controlled in response to string-striking intensity data without the study of the above relationship, it is impossible to reproduce the string-striking velocity at a recording mode with accuracy.

According to results of experiments, we reach a conclusion that the key velocity of the key 1 at a certain position responds to the string-striking velocity of the hammer 2 very well. This position depends on the individual difference between the pianos. However, it can be concluded that the position is lower than the rest position by a depression of 9.0 mm to 9.5 mm or so. Therefore, if the key velocity which appears when the key 1 reaches the above position is controlled in response to the string-striking intensity data, it is possible to reproduce the string-striking velocity at the recording mode with a great degree of fidelity. Hereinafter, the above position is called a reference point Xr.

(2) Reference velocity

Next, it is necessary to set the key velocity at the aforementioned reference point Xr such that the string-striking velocity can be reproduced with fidelity. Hereinafter, the key velocity at the reference point Xr is called a reference velocity Vr.

Figure 5:
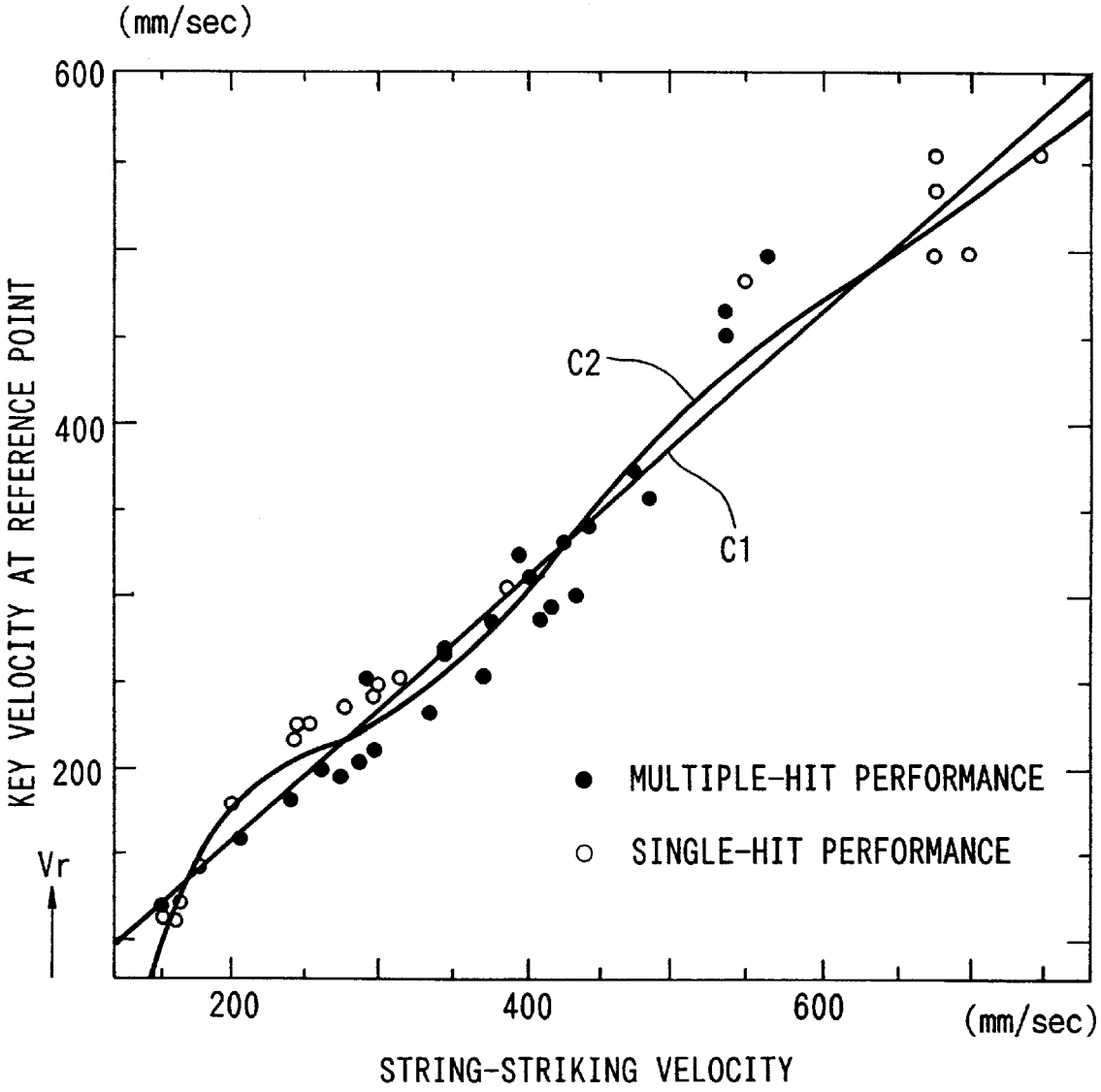
FIG. 5 is a graph showing a relationship between a key velocity and a string-striking velocity which respect to a reference point.

FIG. 5 shows a relationship between the key velocity and string-striking velocity under a condition where the reference point Xr is set at a position which is lower than the rest position by 9.5 mm. In the graph of FIG. 5, white points represent results of the relationship between the key velocity and string-striking velocity with respect to a single-hit performance technique, wherein a human operator completely depresses down the key to the end position. In addition, black points represent the results with respect to a multiple-hit performance technique, wherein a human operator repeats hitting the key in such a way that the key is not depressed down to the end position. In FIG. 5, C1 shows an approximate line based on the first-order least square approximation method while C2 shows an approximate curve based on the sixth-order least square approximation method.

It is obvious from the content of FIG. 5 that the reference velocity Vr can be approximated using each of the line C1 and curve C2. Therefore, it is necessary to select a function having a high degree of approximation. Using such a function, it is possible to determine the reference velocity Vr based on the string-striking intensity data (i.e., string-striking velocity information at the recording mode) which are arbitrarily selected. The present embodiment employs the first-order function approximation whose calculation is simple and whose error is less. Therefore, the reference velocity Vr is calculated in accordance with an equation as follows:

$$Vr=\alpha\cdot V_H+\beta \qquad \text{[Equation 1]}$$

In the above equation 1, $V_H$ represents the string-striking velocity (i.e., string-striking intensity data), while α and β represent constants. The constants α, β are determined by the experiments which are performed with respect to models of the pianos respectively. Incidentally, the constants α, β are changeable in response to the setting of the reference point Xr with respect to the same model of the piano.

(3) Reference time difference

In the present embodiment, string-striking time data included in the performance information is recorded as a time interval in form of a relative time. The player piano at the reproduction mode reads the time intervals to perform accumulation process, by which an absolute string-striking time for reproduction is calculated with respect to each sound. In order to accomplish a string-striking operation accurately at the absolute string-striking time, it is necessary to calculate a time at which the key 1 passes the reference point Xr.

Figure 6:
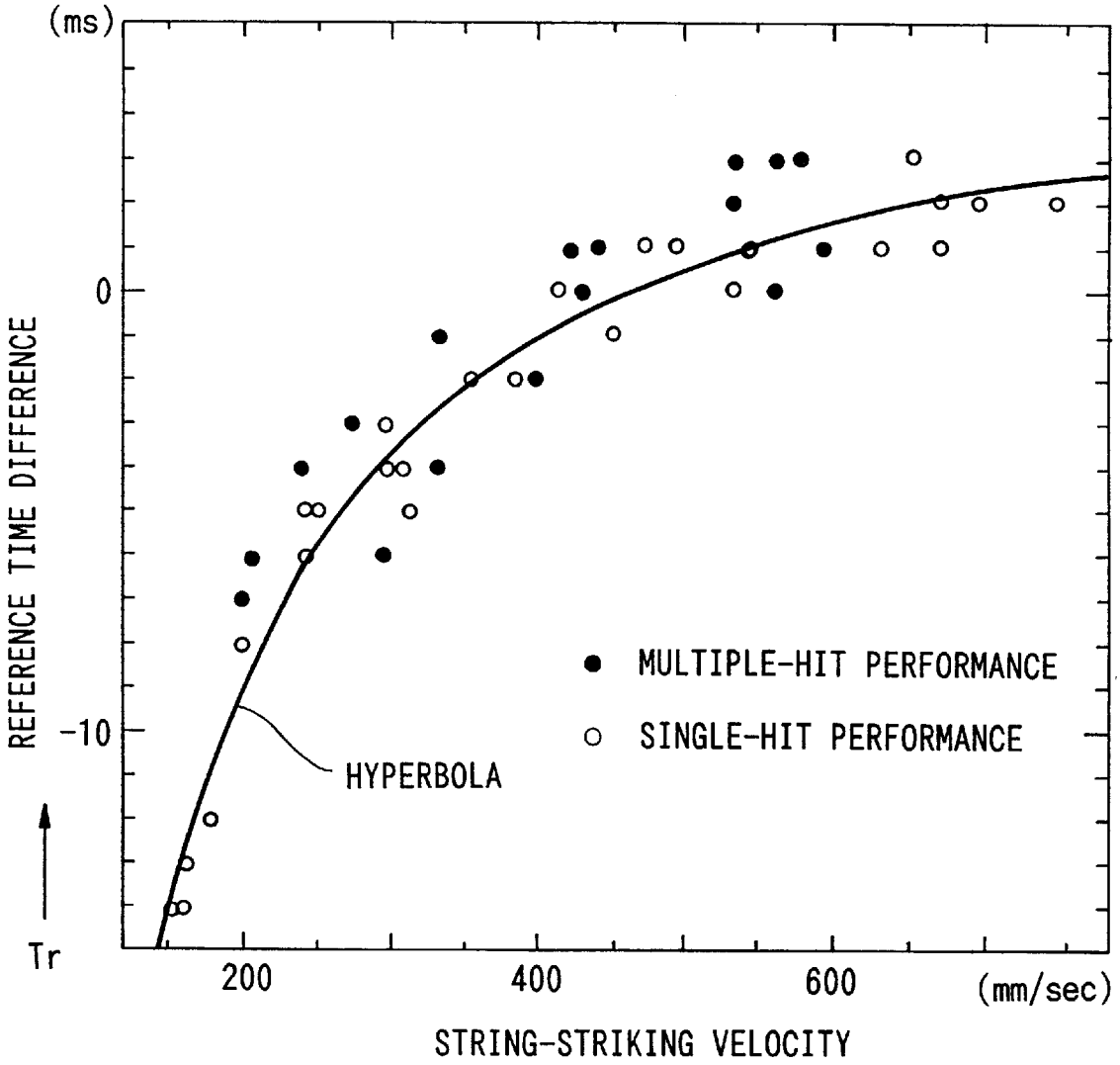
FIG. 6 is a graph showing a relationship between a reference time difference and a string-striking velocity.
Figure 7:
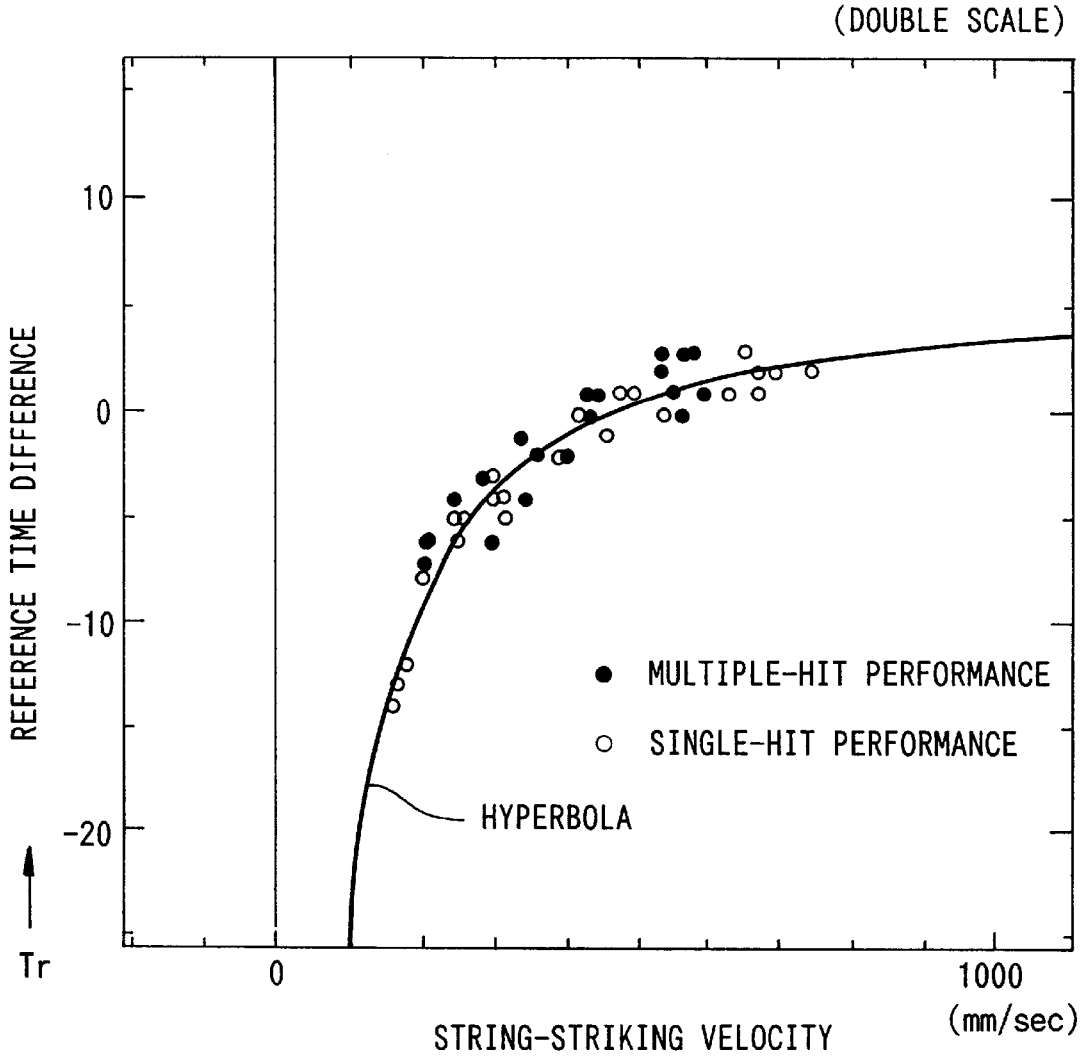
FIG. 7 is a graph showing the graph of FIG. 6 in double scale.
Figure 8:
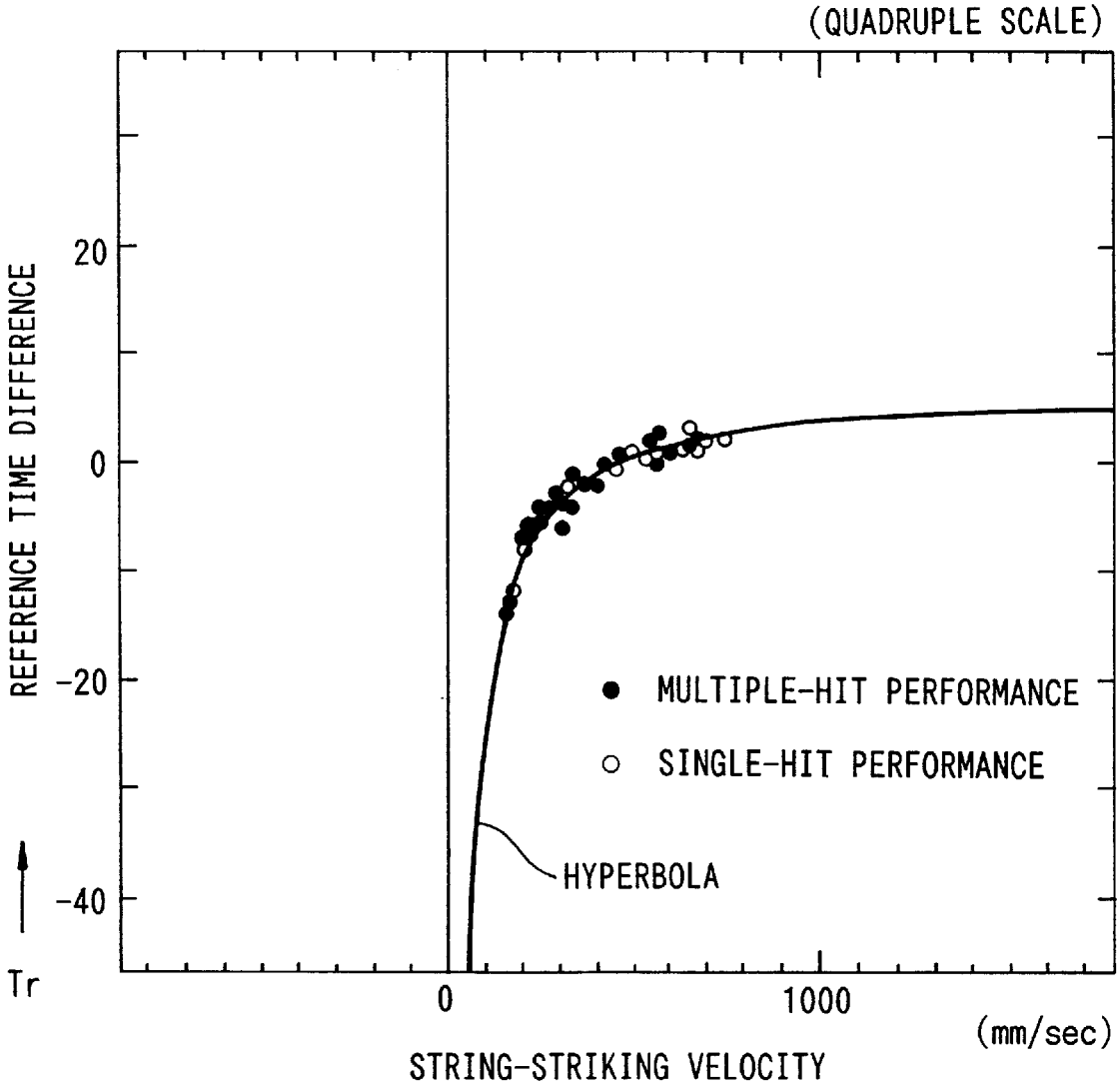
FIG. 8 is a graph showing the graph of FIG. 6 in quadruple scale.

Hereinafter, the time at which the key 1 passes the reference point Xr will be referred to as a reference time tr. Now, the present embodiment provides a reference time difference Tr which defines a time difference between the reference time tr and the string-striking time (accurately speaking, the time at which the hammer 2 passes the sensor SE2 which is placed just before the string-striking position). FIG. 6 shows a relationship between the reference time difference Tr and string-striking velocity, which is obtained through the experiments. In FIG. 6, white points show results of the experiments in accordance with the single-hit performance technique, while black points show results of the experiments in accordance with the multiple-hit performance technique. FIG. 7 shows the graph of FIG. 6 in double scale, while FIG. 8 shows the graph of FIG. 6 in quadruple scale. According to contents of the graphs, it can be said that the relationship between the reference time difference Tr and string-striking velocity can be approximated using the hyperbola very well. The reference time difference Tr can be approximated by one-variation equation where the string-striking velocity $V_H$ is used as a denominator. Namely, Tr can be calculated in accordance with an equation as follows:

$$Tr=-\frac{\gamma}{V_H}+\delta \qquad \text{[Equation 2]}$$

In the above equation 2, constants γ and δ are determined by the experiments with respect to models of the pianos respectively. In addition, the constants γ, δ are changeable in response to the setting of the reference point Xr with respect to the same model of the piano, which is similar to the aforementioned constants α, β.

As described above, the reference time difference Tr is calculated in accordance with the equation 2. Then, the reference time tr is calculated by subtracting the reference time difference Tr from the absolute string-striking time for the reproduction. After all, using the aforementioned processes corresponding to (1) to (3), it is possible to produce the reference point Xr, the reference velocity Vr and the reference time tr. So, the key 1 is driven in such a way that the key 1 reaches the reference point Xr at the reference time tr with the reference velocity Vr. Thus, it is possible to reproduce a string-striking state at the recording mode with fidelity.

Incidentally, if the string-striking operation is performed at a time when the key 1 reaches the reference point Xr, it is not necessary to provide the process of calculating the reference time difference Tr.

(4) Creation of trajectory data of key depression

Figure 9:
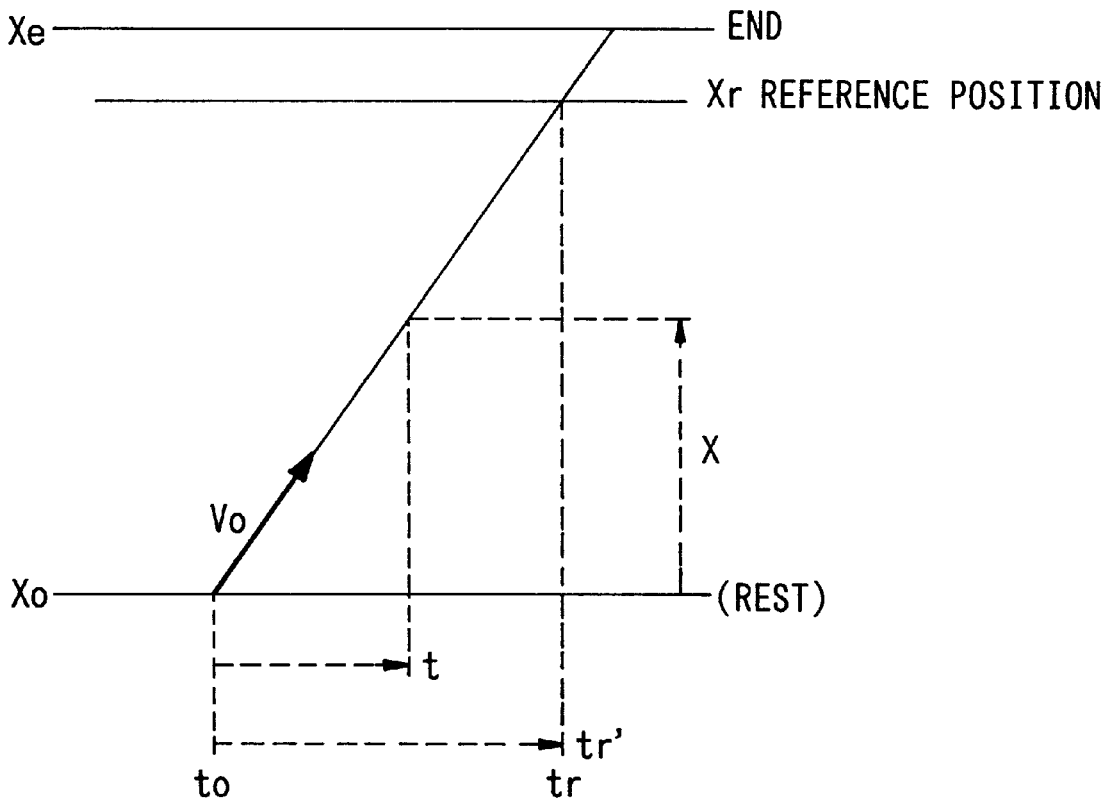
FIG. 9 shows an example of a key-depression trajectory.

FIG. 9 shows an example of a key-depression trajectory along which a moving end of a key moves in response to a key-depression operation. Herein, the key is subjected to uniform motion so that the moving end of the key moves from a rest position $X_0$ to an end position Xe. Using an initial velocity $V_0$, a position X of the key and a time t which elapses from a drive-starting point of the key, the trajectory of the key is represented by an equation as follows:

$$X=V_0 \cdot t+X_0 \quad \text{[Equation 3]}$$

Using a time tr' representing an arrival time at which the key reaches the reference point Xr, the reference point Xr is represented by an equation as follows:

$$Xr=V_0 \cdot tr'+X_0 \quad \text{[Equation 4]}$$

From the above equation 4, it is possible to calculate the time tr'. So, it is possible to calculate an absolute time $t_0$ at which the key depression is started (hereinafter, referred to as a key-depression start time $t_0$) in accordance with an equation as follows:

$$t_0 = tr - tr' = tr - \frac{Xr - X_0}{V_0} \quad \text{[Equation 5]}$$

Incidentally, the reference time tr is calculated, as described before, by subtracting the reference time difference T from the string-striking time.

As described above, the key-depression start time $t_0$ is calculated in accordance with the equation 5. So, by driving the key 1 in response to an trajectory which is calculated using the aforementioned equation 3, the key 1 is moved to reach the reference point Xr accurately at the reference time tr with the reference velocity Vr corresponding to the string-striking intensity data.

Incidentally, the present embodiment presumes a behavior (or movement) of the key to be equivalent to a linear trajectory (in uniform motion). So, the reference velocity Vr is equal to the initial velocity $V_0$. In addition, the reference velocity Vr is calculated in accordance with the foregoing equation 1. As a result, it is possible to perform a control (i.e., velocity control) such that the key is driven from the key-depression start time $t_0$ with the "constant" velocity of Vr.

(5) Creation of trajectory data of key release

Next, a description will be given with respect to creation of trajectory data for a key-release operation.

Using a key position XN, a key-release initial velocity $V_0N$ (<0) and a time tN which elapses from a key-release start time as well as the end position Xe of the key, a key-release trajectory can be represented by an equation as follows:

$$XN=V_0N \cdot tN+Xe \quad \text{[Equation 6]}$$

Figure 10:
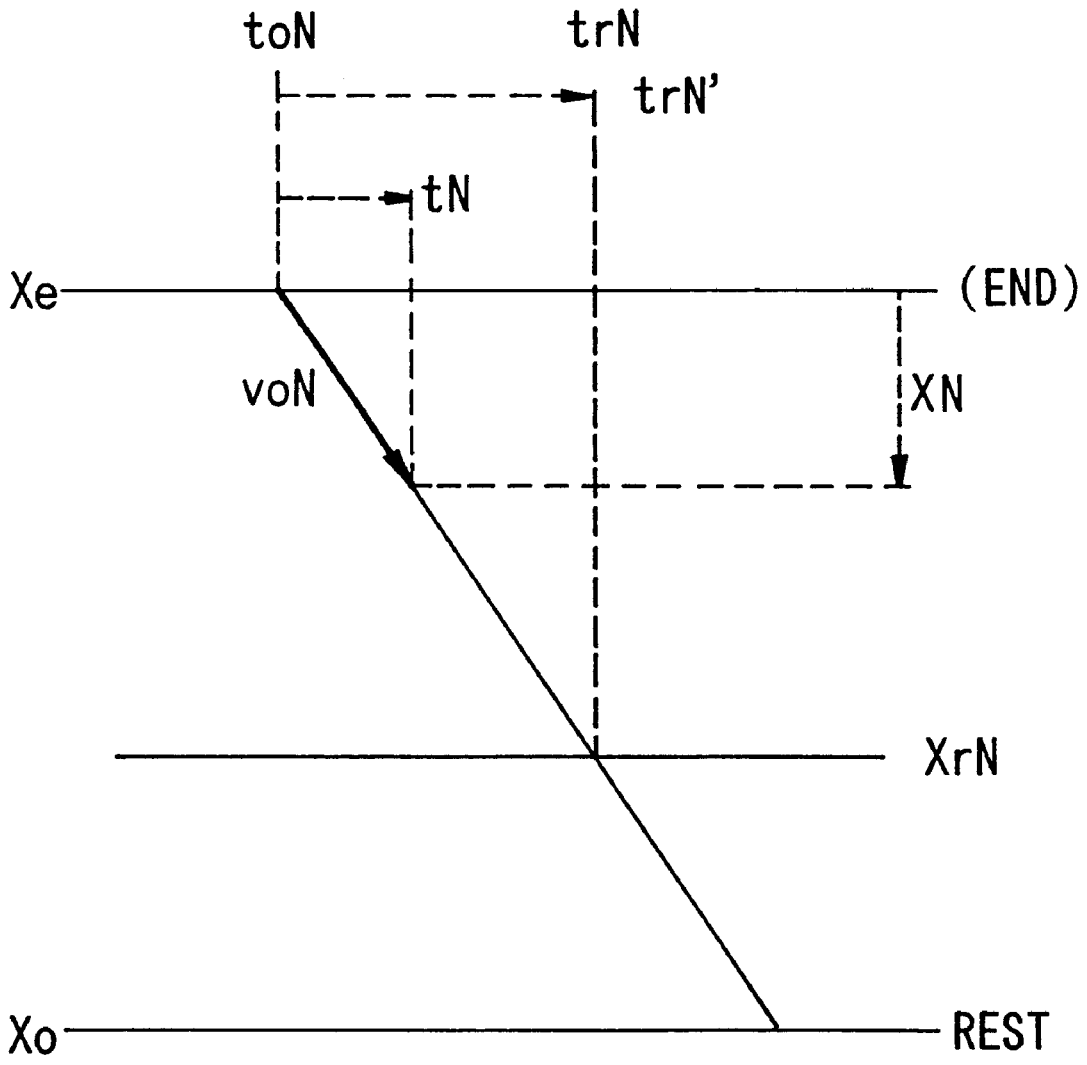
FIG. 10 shows an example of a key-release trajectory.

FIG. 10 shows an example of the key-release trajectory which is represented by the above equation 6.

As described before, the performance recording unit 30 (see FIG. 1) measures a period of time between a first time instant when the lower photo-sensor SF3 within the key sensor 25 is placed in a light-receiving state and a second time instant when the upper photo-sensor SF2 is placed in a light-receiving state, thus detecting a key-release velocity VkN. In addition, the performance recording unit 30 detects the timing that the upper photo-sensor SF2 is placed in the light-receiving state as a key-release time tkN. At the key-release time tkN, the damper 6 is placed in contact with the string 4 to start attenuation of sound. In other words, the positions of the photo-sensors are adjusted in advance such that the damper 6 is capable of starting the attenuation of the sound as described above. Then, the key-release velocity VkN and the key-release time tkN which are detected by the performance recording unit 30 are recorded as data constructing the performance information, then, they are read out at the reproduction mode.

A position of the key by which the damper 6 comes in contact with the string 4 is defined as a key-release reference point XrN. Thus, it can be declared that a key-release state is established when the key 1 reaches the key-release reference point XrN. So, the key position is controlled in such a manner that the key-release time tkN of the performance information coincides with a time (i.e., key-release reference time trN) at which the key 1 reaches the key-release reference point XrN. By controlling the key position in such a manner, it is possible to control the key-release timing with accuracy.

A velocity of the damper 6 which comes in contact with the string 4 greatly affects an attenuation state of sound. So, it is preferable to reproduce the above velocity with fidelity. This velocity corresponds to the key-release velocity VkN. Therefore, by coinciding the key velocity at the key-release reference point XrN (hereinafter, referred to as key-release reference velocity VrN) accurately with the key-release velocity VkN, it is possible to accurately reproduce the attenuation state of the sound.

Using a time to start driving of the key as a basis (i.e., time 0), the present embodiment measures a time (denoted by a symbol trN') at which the key reaches the key-release reference point XrN. Herein, it is possible to establish a relationship between them by an equation as follows:

$$XrN=V_0N \cdot trN'+XeN \quad \text{[Equation 7]}$$

where because of the linear trajectory, $V_0N$=VrN=VkN. Using the above equation 7, it is possible to calculate the time trN'. Therefore, it is possible to calculate a key-release start time $t_0N$ by an equation as follows:

$$t_0N = trN - trN' = trN - \frac{XrN - XeN}{V_0N} \quad \text{[Equation 8]}$$

Using the above equation 8, the present embodiment calculates the key-release start time $t_0N$, based on which the key is driven to follow an trajectory represented by the foregoing equation 6. Thus, the key is capable of reaching the key-release reference point XrN accurately at the key-release time trN. So, it is possible to reproduce a key-release state of the recording mode with fidelity.

Incidentally, even if the key is driven or the key velocity is controlled to have the velocity $V_0N$ (=VkN: key-release velocity) at the time to, it is possible to obtain effects similar to the above.

(6) Creation of key-depression-slow-down trajectory data and key-release-slow-up trajectory data (a) Transit position The key-depression trajectory and key-release trajectory which are produced as described above are each linear trajectory of uniform motion. Hereinafter, the key-depression trajectory is referred to as a key-depression-uniform-motion trajectory, while the key-release trajectory is referred to as a key-release-uniform-motion trajectory. Suppose a situation where the aforementioned half stroke is employed in a transition of key motion from a key-depression to a key-release. In such a situation, the key-depression-uniform-motion trajectory and key-release-uniform-motion trajectory cross each other prior to the end position Xe (see FIG. 11A). At the key depression, the player piano of the present embodiment controls the movement of the key 1 on the basis of the key-depression-uniform-motion trajectory with respect to a range of distance between the rest position X0 and a transit position XT which is determined in advance. With respect to a range of distance between the transit position XT and the end position Xe, the movement of the key 1 is controlled based on a quadratic-curve trajectory (hereinafter, referred to as a key-depression-slow-down trajectory). At the key release, the movement of the key 1 is controlled based on the key-release-uniform-motion trajectory with respect to the range of distance between the transit position XT and the rest position X0. With respect to the range of distance between the transit position XT and the end position Xe, the movement of the key 1 is controlled based on a quadratic-curve trajectory. A time at which the moving end of the key moves along the key-depression-uniform-motion trajectory to reach the transit position XT is referred to as a key-depression intermediate time tPT, while a time at which the key starts moving along the key-release-uniform-motion trajectory at the transit position XT is referred to as a key-release intermediate time tNT.

The transit position XT is adequately determined to provide the key 1 with a natural movement. If the key-depression-uniform-motion trajectory is too short, the reproducibility of the string-striking velocity becomes unstable. So, as for the transition of the key motion from the key depression to the key release, the transit position XT is slightly shifted toward the end position Xe from a middle position between the rest position X0 and the end position Xe.

(b) Calculations of uniform-motion cross time tc

Figure 11A:
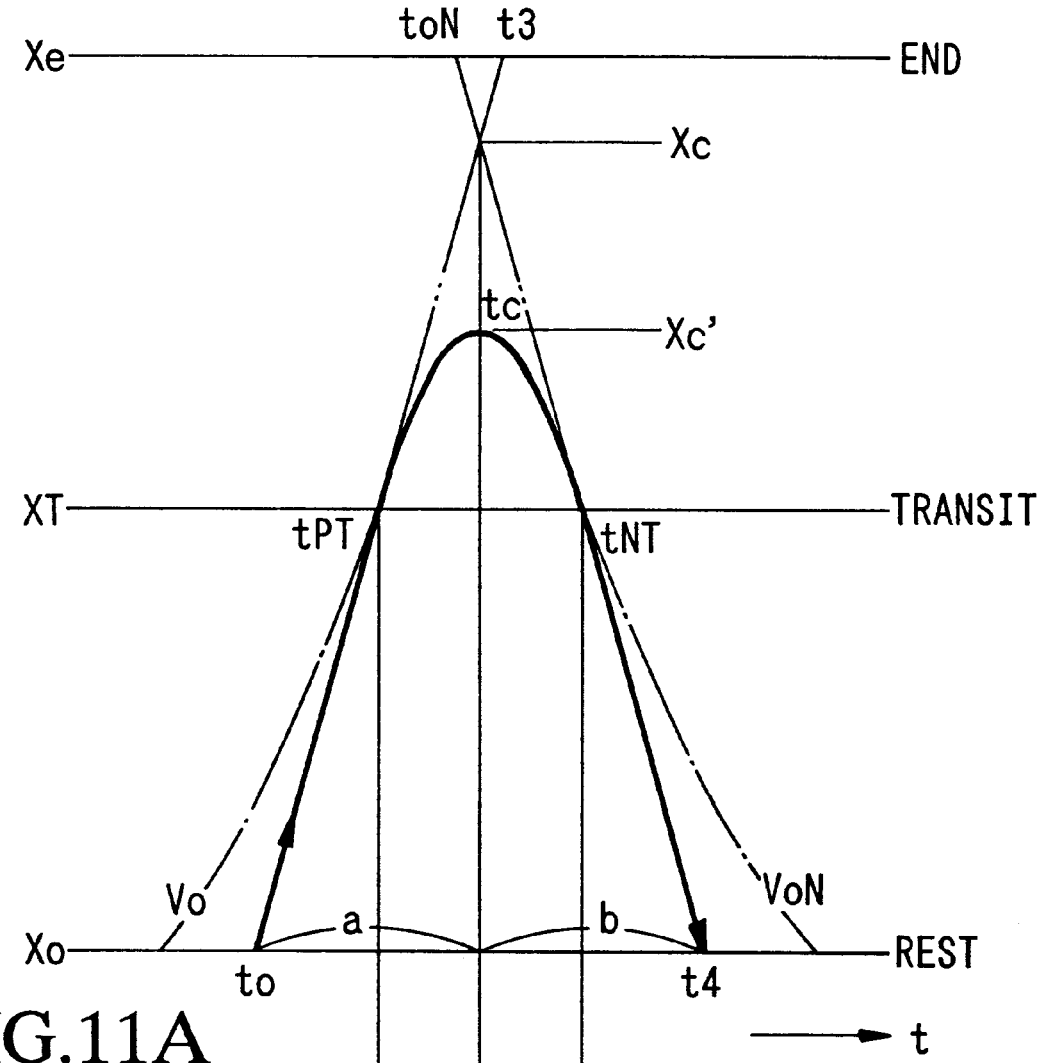
FIG. 11A is a graph showing a trajectory motion of a key with respect to a key-depression-slow-down trajectory and a key-release-slow-up trajectory which cross each other.
Figure 11B:
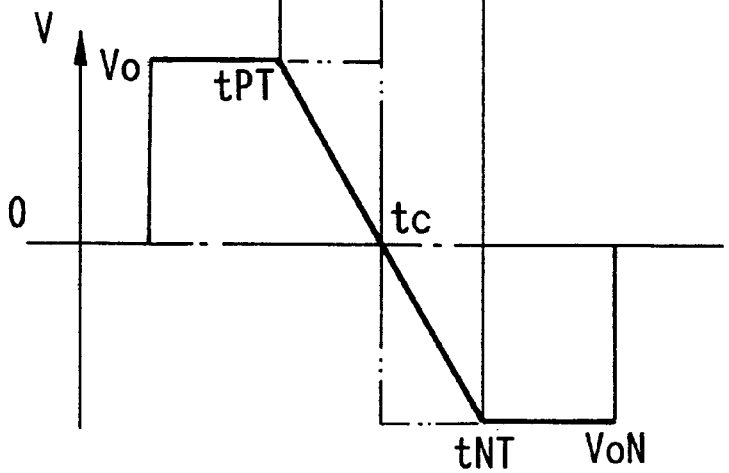
FIG. 11B is a graph showing a manner of variations of a key velocity in connection with FIG. 11A.

As shown in FIG. 11A, a position at which the key-depression-uniform-motion trajectory and key-release-uniform-motion trajectory cross each other is referred to as a uniform-motion cross position Xc. In addition, a time instant at which the key reaches the uniform-motion cross position Xc is referred to as a uniform-motion cross time tc. The uniform-motion cross time can be calculated from the trajectory data of the key-depression-uniform-motion trajectory and key-release-uniform-motion trajectory. So, the key-depression-slow-down trajectory and key-release-slow-up trajectory are set such that the key velocity becomes zero at the uniform-motion cross time tc. In the case of the key-depression-slow-down trajectory shown in FIG. 11B, for example, the key is controlled to move along an trajectory which is set such that the key velocity V changes from $V_0$ to zero in a duration which elapses from the key-depression intermediate time tPT to the uniform-motion cross time tc. In the case of the key-release slow-up trajectory, the key is controlled to move along an trajectory which is set such that the key velocity V changes from zero to $V_0N$ (<0) in a duration which elapses from the uniform-motion cross time tc to the key-release intermediate time tNT.

Next, a description will be given with respect to calculations to produce the uniform-motion cross time tc.

Using a time "a" which elapses from the key-depression start time $t_0$ to the uniform-motion cross time tc as well as a time "b" which elapses from the uniform-motion cross time tc to a time instant $t_4$ at which the key-release-uniform-motion trajectory ends, it is possible to establish equations as follows:

$$V_0 \cdot a = -V_0 N \cdot b \quad \text{[Equation 9]}$$

$$a + b = t_4 - t_0 \quad \text{[Equation 10]}$$

Using the above equations 9 and 10, it is possible to establish an equation as follows:

$$a = \frac{V_0 N(t_4 - t_0)}{V_0 N - V_0} \quad \text{[Equation 11]}$$

Because the uniform-motion cross time tc is calculated by adding the time "a" to the key-depression start time $t_0$, it is calculated in accordance with an equation as follows:

$$tc = t_0 + a = t_0 + \frac{V_0 N(t_4 - t_0)}{V_0 N - V_0} = \frac{V_0 N \cdot t_4 - V_0 \cdot t_0}{V_0 N - V_0} \quad \text{[Equation 12]}$$

Incidentally, $t_4$ of the equation 12 represents a time instant at which the moving end of the key moves along the key-release-uniform-motion trajectory to reach the rest position $X_0$. So, the time $t_4$ can be calculated using $t_0N$ which is produced by the aforementioned equation 8, in accordance with an equation as follows:

$$t_4 = t_0 N - \frac{Xe - X_0}{V_0 N} \quad \text{[Equation 13]}$$

(c) Creation of key-depression-slow-down trajectory data

Next, a key-depression acceleration "aP" in the key-depression-slow-down trajectory is calculated by an equation as follows:

$$aP = -\frac{V_0}{tc - tPT} \quad \text{[Equation 14]}$$

Herein, tPT of the equation 14 is calculated as follows:

$$tPT = t_0 + \frac{XT - X_0}{V_0} \quad \text{[Equation 15]}$$

Using the key-depression acceleration aP (<0) calculated by the equation 14, it is possible to calculate a key-depression velocity V in the key-depression-slow-down trajectory by an equation as follows:

$$V = V_0 + aP(t - tPT) \quad \text{[Equation 16]}$$

So, the key-depression-slow-down trajectory can be represented by an equation as follows:

$$X = P_1 \cdot t^2 + Q_1 \cdot t + R_1 \quad \text{[Equation 17]}$$

where t denotes an absolute time instant in the key-depression-slow-down trajectory as well as the key-release-slow-up trajectory.

In addition, $P_1$, $Q_1$, $RI_1$ are constants, which are produced by placing a specific value of t, shown in FIG. 11A, into the aforementioned equation 17 and an equation which is produced by performing differentiation on the equation 17 with respect to t. The equation 17 represents a secondary function that a gradient of $V_0$ is given at a time tPT while a gradient is zero at the uniform-motion cross time tc. In addition, the equation 17 produces a value of XT at the time tPT. Therefore, the above values are placed into the equations.

(d) Creation of key-release-slow-up trajectory data

Next, a key-release acceleration aN (<0) in the key-release-slow-up trajectory is calculated by an equation as follows:

$$aN = \frac{V_0 N}{tNT - tc} \quad \text{[Equation 18]}$$

In the above equation 18, tNT is calculated as follows:

$$tNT = t_4 + \frac{XT - X_0}{V_0 N} \quad \text{[Equation 19]}$$

In addition, a key-release velocity V in the key-release-slow-up trajectory is calculated by an equation as follows:

$$V = aN(t - tc) \quad \text{[Equation 20]}$$

The key-release-slow-up trajectory can be represented by an equation as follows:

$$XN = P_2 \cdot t^2 + Q_2 \cdot t + R_2 \quad \text{[Equation 21]}$$

In the above equation, $P_2$, $Q_2$, $R_2$ are constants, which are produced by placing a specific value of t, shown in FIG. 11A, into the equation 21 as well as an equation which is produced by performing differentiation on the equation 21 with respect to t. The equation 21 represents a secondary function that a gradient of $V_0N$ is given at the time tNT while the gradient is zero at the uniform-motion cross time tc. In addition, the equation 21 produces a value of XT at the time tNT. Therefore, the above values are placed into the equation. Incidentally, a maximum value of the equation 21 becomes equal to a maximum value of the equation 17. For this reason, secondary curves represented by the equations 17 and 21 cross each other at the uniform-motion cross time tc.

As described heretofore, the present embodiment creates the key-depression trajectory data and key-release trajectory data as well as the key-depression-slow-down trajectory data and key-release-slow-up trajectory data, by which it is possible to reproduce an overall trajectory of the key 1.

[D] Recording process

Next, a description will be given with respect to processes of the present embodiment, wherein a recording process is described at first.

When a performer (i.e., a human operator or a user) plays music performance using the player piano of the present embodiment, the performance recording unit 30 detects a string-striking velocity $V_H$ and a string-striking time on the basis of output signals of the sensors SE1 and SE2. In addition, it detects a key-depression velocity Vk, a key-depression time tk, a string-striking velocity $V_H$ and a string-striking time on the basis of output signals of the photo-sensors SF2 and SF3 constructing the key sensor 25. Those pieces of information are subjected to normalization process by the post-recording processing unit 31, so they are used as performance information, which is recorded on a recording media such as a floppy disk.

[E] Reproduction process

Figure 12:
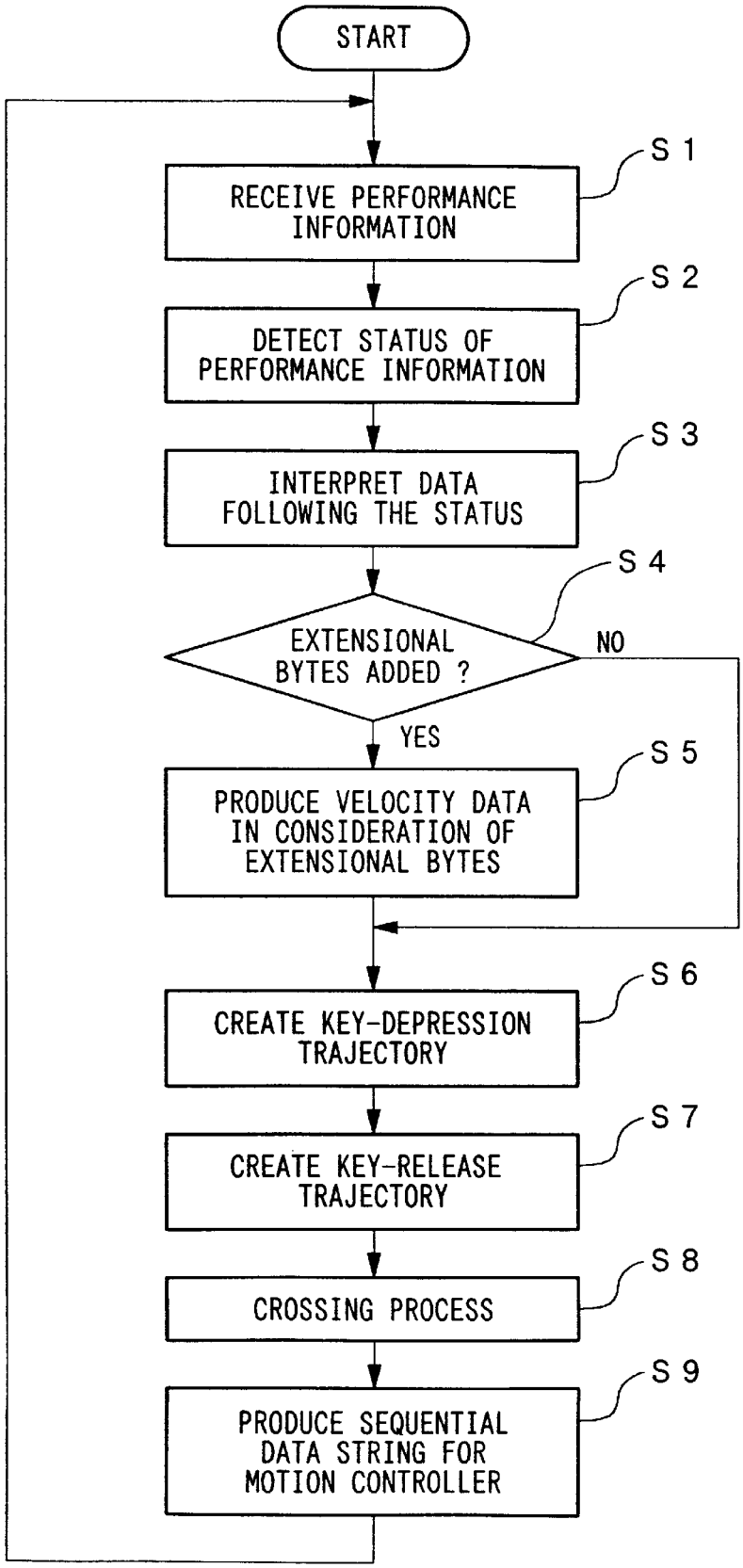
FIG. 12 is a flowchart showing a reproduction process of the player piano in accordance with the embodiment of the invention.

Next, a description will be given with respect to a reproduction process of the present embodiment in conjunction with FIG. 12 and FIG. 14. Herein, FIG. 12 is a flowchart showing the reproduction process of the player piano of the present embodiment. The description of the reproduction process is given with regard to specific cases, i.e., first to fourth cases.

(1) First case where performance information recorded by the player piano of the present embodiment is reproduced by the player piano of the present embodiment.

In step S1 of FIG. 12, the pre-reproduction processing unit 10 reads performance data from a recording media, or the pre-reproduction processing unit 10 receives performance information supplied thereto from an external device. In step S2, the pre-reproduction processing unit 10 detects a status of the performance information. Concretely speaking, detection of the status is performed as follows:

The data values used for the status are stored in a table in advance. When the performance information is supplied, the unit reads the data values from the table so as to search one coinciding with a data value of the status of the performance information. For example, if the performance information corresponds to "B0 51 vv" shown in FIG. 3, the unit detects that the status of the performance information represents a key-depression event.

In step S3, the pre-reproduction processing unit 10 performs interpretation on data following the status of the performance information. In the case of FIG. 3, the unit interprets a third byte "vv" following the status "B0 51" as a key-depression velocity. In the key-depression event frame, a note number designator is arranged just before the key-depression event, by which it is possible to detect a note number of the key-depression event.

In step S4, the pre-reproduction processing unit 10 makes a decision as to whether extensional bytes are added to the performance information or not. As described before, a status of the extensional bytes is indicated by "B0 10", while each event is represented by three bytes. Herein, each event consisting of three bytes including the status detected by the step S2 is followed by extensional bytes, so a first extensional byte is detected as a fourth byte while a second extensional byte is detected as a fifth byte. So, the unit makes a decision as to whether the detected fourth byte corresponds to "B0" while the detected fifth byte corresponds to "10" or not.

In the case of FIG. 3, for example, the performance information is configured by the key-depression event of "B0 51 vv" and the extensional bytes of "B0 10 wr". In this case, a result of the decision of the step S4 is "YES", so the unit proceeds to step S5 wherein a key velocity is detected in consideration of the extensional bytes. In the above case, the extensional bytes are added to the key-depression event, so the unit detects a key-depression velocity as an equivalence of ten bits consisting of "vv" (i.e., seven bits) written in a third byte of the key-depression event and "w" (i.e., three bits) written in a third extensional byte.

If the fourth byte, counted from first one of the status detected in the step S2, corresponds to "B0" but the fifth byte does not correspond to "10", a result of the decision of the step S4 turns to "NO", so the unit proceeds directly to step S6. In that case, it is presumed that no data exist for extension, but it is also presumed that each event normally provides extensional bytes. So, the unit treats velocity data of seven bits as data of ten bits. Concretely, a series of bits "000" are added as low-order bits to the data of seven bits, so that velocity data of ten bits are created. Thus, even if extensional bytes are not added to the event, it is possible to standardize a number of bits treated by the process of latter stage as ten bits.

In step S6, the pre-reproduction processing unit 10 creates key-depression trajectory data in accordance with the equation 3. The key-depression trajectory is formed as a path from the rest position $X_0$ to the end position Xe. The key-depression trajectory data are created based on the key-depression time and key-depression velocity of the key-depression event as well as the string-striking time and string-striking velocity of the string-striking event. Then, the unit proceeds to step S7 so as to create key-release-uniform-motion trajectory data in accordance with the equation 6.

The key-release-uniform-motion trajectory data are created based on the key-release time and key-release velocity of the key-release event.

In step S8, the pre-reproduction processing unit 10 performs a crossing process to produce a key-depression-slow-down trajectory and a key-release-slow-up trajectory. Using the equation 12, the unit calculates the uniform-motion cross time tc at which the above two trajectories cross each other. The unit calculates the key-depression acceleration aP for the key-depression-slow-down trajectory in accordance with the equation 14. In addition, the unit calculates the key-release acceleration aN for the key-release-slow-up trajectory in accordance with the equation 18. Using the calculated accelerations aP and aN, the unit creates the key-depression-slow-down trajectory data and key-release-slow-up trajectory data in accordance with the equations 15 and 19 respectively. Incidentally, if the key-depression-uniform-motion trajectory and key-release-uniform-motion trajectory do not cross each other, it is possible to omit the step S8.

Proceeding to step S9, the unit produces position data (t, X) to be supplied to the motion controller 11. Herein, the position data consist of the time t and the position X at which the key is located at the time t. The time t is placed somewhere between the key-depression start time $t_0$ and the key-release end time $t_4$, an interval of time of which is divided by a certain pitch. So, the time t progresses by the pitch. By the way, it is possible to shorten the pitch for the time t with respect to the key-depression-slow-down trajectory and key-release-slow-up trajectory, while it is possible to enlarge the pitch for the time t with respect to the key-depression-uniform-motion trajectory and key-release-uniform-motion trajectory. Therefore, by setting (or arbitrarily changing) the pitch for the time t, it is possible to simplify calculations of the position data (t, X) with respect to the key-depression-uniform-motion trajectory and key-release-uniform-motion trajectory. In addition, it is possible to make the motion of the key 1 smooth and accurate with respect to the key-depression-slow-down trajectory and key-release-slow-up trajectory.

The position X of the key is calculated by placing a value of the time t into the trajectory data which are calculated as described above. With respect to a duration between the key-depression start time $t_0$ and the key-depression intermediate time tPT, a value of the time t is placed into the equation 3 to calculate a value of the position X of the key 1 in the key-depression-uniform-motion trajectory. With respect to a duration between the key-depression intermediate time tPT and the uniform-motion cross time tc, a value of the time t is placed into the equation 17 to calculate a value of the position X of the key 1 in the key-depression-slow-down trajectory. Further, with respect to a duration between the uniform-motion cross time tc and the key-release intermediate time tNT, a value of the time t is placed into the equation 21 to calculate a value of the position X of the key 1 in the key-release-slow-up trajectory. With respect to a duration between the key-release intermediate time tNT and the key-release end time $t_4$, a value of the time t is placed into the equation 6 to calculate a value of the position X of the key 1 in the key-release-uniform-motion trajectory. The position data (t, X) which are produced by calculations described above are sequentially stored in a memory (not shown) provided in the pre-reproduction processing unit 10, wherein they are stored at addresses which start from a prescribed address and which change in an order corresponding to the time t. Using storage of the position data described above, it is possible to produce a sequential data string by calculating the position X of the key with respect to each value of the time in a duration between the key-depression start time and key-release end time.

The performance data of a tune contains the aforementioned string-striking event frame, key-depression event frame and key-release event frame, among which interval data are inserted. Herein, the interval time represent a time difference between time instants at which event frames occur respectively. So, the performance data consisting of the event frames accompanied with the interval data are stored in a recording media. At reproduction (or playback) of the tune, the player piano reads a set of the event frame and its following interval data. When a time represented by the read interval data passes away, the player piano reads a set of the next event frame and interval data. Such a manner of reading is repeated.

The player piano requires a certain duration between the timing at which the power supply for the solenoid is started and the timing at which the hammer actually strikes the string to produce sound. For this reason, the timing of the actual generation of the sound delays from the timing at which the string-striking event frame is read from the recording media. In addition, a duration between the timing at which the power supply to the solenoid is started and the timing at which the hammer actually strikes the string depends on the string-striking velocity which is designated. For this reason, if the power supply to the solenoid is started at the timing at which the string-striking event frame is read from the recording media, an interval of time in occurrence between the string-striking events should change in response to the string-striking velocity designated by each string-striking event. Similar problems occur with respect to the operations regarding the key release as well.

To solve the above problems, the events are uniformly delayed with regard to the reproduction of the player piano in such a way that when a prescribed time (e.g., 500 milli-second) passes after the timing to read each event frame, an operation (e.g., string-striking operation, key-release operation) designated by each event frame is performed. Concretely speaking, at the timing to read the string-striking event frame (or key-release event frame), the aforementioned trajectory calculations are performed to produce the timing at which the key motion should be started and which precedes the string-striking timing (or key-release timing) by a certain amount of time. So, the key motion is started by the above timing. Incidentally, the string-striking timing (or key-release timing) is set later than the timing to read the string-striking event frame (or key-release event frame) by 500 milli-second (abbreviated by "msec").

The aforementioned manner of timing control will be explained with reference to FIG. 14A, FIG. 14B and FIG. 14C. Suppose that the player piano reads a string-striking event frame and a key-release event frame at different timings shown in FIG. 14A. As for a string-striking event (see FIG. 14B), a key drive is started at the timing which precedes a string-striking timing by a sum of a reference time Tr and a time tr'. Thus, a key motion is started when a time of "500 msec—(Tr+tr')" passes after the timing to read the string-striking event frame; thereafter, a string-striking operation is actually performed when 500 msec passes after the timing to read the string-striking event frame.

The key-release event designates a start of the muting operation. In the player piano, the key-release corresponds to an operation to make the damper 6 in contact with the string 4. In the case of the key-release event (see FIG. 14C), a key drive is started at the timing which precedes the key-release timing by a time trN'. So, a key motion is started at the timing when a time of (500 msec—trN') passes after the timing to read the key-release event frame. Thus, at the timing when 500 msec passes after the timing to read the key-release event frame, the damper 6 comes in contact with the string 4 to actually mute the sound. Incidentally, if the performance is reproduced using the electronic musical instrument, it is not necessary to provide the foregoing delay in reproduction-related timings of the player piano. So, the electronic musical instrument is capable of starting synthesis of the musical tone signal at the timing to read the string-striking event frame from the recording media. In addition, the electronic musical instrument is capable of starting muting of the musical tone signal at the timing to read the key-release event frame from the recording media.

As described heretofore, the present embodiment is designed to represent the performance information using the key-depression event(s), so it is possible to reproduce the key-depression-slow-down trajectory and key-release-slow-up trajectory smoothly and accurately. In addition, the present embodiment uses the extensional bytes, so it is possible to enlarge the dynamic range in velocity of the recording. For this reason, even in the case of a transition in music from the pianissimo to the forte that the key velocity greatly changes, it is possible to perform reproduction of such a transition with accuracy. So, it is possible to reproduce a delicate nuance with respect to the automatic performance.

(2) Second case where the player piano of the present embodiment reproduces the performance information recorded by the conventional player piano.

The conventional player piano uses the foregoing string-striking event and key-release event as the performance information, but it does not use the key-depression event. When receiving such performance information recorded by the conventional player piano, the player piano of the present embodiment transfers control to the pre-reproduction processing unit 10 so as to extract the performance information (see step S1 in FIG. 12). In step S2, the unit detects a status of the performance information.

In this case, the status regarding a string-striking operation should be limited to "90" which designates a string-striking event or "80" which designates a key-release event. For this reason, a result of interpretation for the status of the performance information should be either the string-striking event or the key-release event. As described before, the conventional player piano does not use extensional bytes. So, a result of decision of step S4 turns to "NO". Therefore, the unit proceeds directly to step S6 in which a decision is made as to whether the string-striking operation contains a set of string-striking event, key-depression event and key-release event or not. Because the key-depression event is not contained in the performance information, key-depression-uniform-motion trajectory data are created based on a string-striking time and a string-striking velocity of the string-striking event. Thereafter, the unit proceeds to step S7 to create key-release-uniform-motion trajectory data in accordance with the equation 6. Herein, the key-release-uniform-motion trajectory data are created based on a key-release time and a key-release velocity of the key-release event.

In step S8, the unit performs a crossing process based on the key-depression event. After completion of the step S8, the pre-reproduction processing unit 10 produces position data (t, X) to be supplied to the motion controller 11 on the basis of the trajectory data which are created by the aforementioned step S7. The position data are sequentially stored in an internal memory of the pre-reproduction processing unit 10 at addresses which start from a prescribed address and which change in an order of the time t. Thus, the unit produces a sequential data string by calculating a value of the position X of the key with respect to each value of the time t in a duration between the key-depression start time and key-release end time.

As described above, the player piano of the present embodiment uses the same statuses of the string-striking event and key-release event which are used by the conventional player piano. So, the player piano of the present embodiment is capable of reproducing the performance information which is recorded by the conventional player piano. In this case, velocity data of the string-striking event (or key-release event) which are produced by the conventional player piano are represented by one byte (concretely, seven bits). The player piano of the present embodiment is designed to write low-order bits to extensional bytes such that the above seven bits of the velocity data of the conventional player piano can be treated as high-order seven bits of velocity data. So, the player piano of the present embodiment is capable of reproducing the key velocity with a precision similar to that of the conventional player piano. In short, the player piano of the present embodiment has a compatibility with the conventional player piano such that the performance information recorded by the conventional player piano can be reproduced without being damaged at all by the player piano of the present embodiment.

(3) Third case where the performance information recorded by the player piano of the present embodiment is reproduced by the conventional player piano.

The player piano of the present embodiment uses the key-depression event and extensional bytes in addition to the string-striking event and key-release event for formation of the performance information. Herein, the player piano of the present embodiment uses statuses for discrimination of the key-depression event and extensional bytes, which are not used by the conventional player piano. When inputting an undefined status, the conventional player piano neglects it to perform an error process. For this reason, when the performance information recorded by the present embodiment is reproduced by the conventional player piano, the key-depression event and extensional bytes are neglected. In addition, the player piano of the present embodiment uses statuses for discrimination of the string-striking event and key-release event, which are used by the conventional player piano as well. So, the conventional player piano is capable of reproducing the string-striking event and key-release event used by the player piano of the present embodiment.

Suppose a situation where the conventional player piano reproduces performance information consisting of a string-striking event frame of "90 kk vv" plus "B0 10 wr", a key-depression event frame of "B0 50 kk" plus "B0 51 vv", and a key-release event frame of "80 kk vv". In such a situation, the conventional player piano is capable of recognizing a status of "90" used by the string-striking event frame and a status of "80" used by the key-release event frame. However, the conventional player piano is not capable of recognizing a status of "B0 50" and a status of "B0 51" which are used by the key-depression event frame. For this reason, the conventional player piano neglects extensional bytes "B0 10 wr" of the string-striking event frame and the key-depression event frame. So, the conventional player piano produces trajectory data based on a string-striking event of "90 kk vv" and a key-release event of "80 kk vv". Incidentally, "vv" of the string-striking event frame indicates high-order seven bits of the string-striking velocity, while "wr" indicates low-order three bits of the string-striking velocity. In this case, the conventional player piano neglects the low-order three bits of the string-striking velocity. However, the conventional player piano is originally designed to cope with seven bits of the string-striking velocity. So, even if the low-order three bits are neglected, it cannot be said that a precision of reproduction of the key velocity is deteriorated. In other words, it is possible to reproduce a key motion with a maximum precision which is expected. In short, if the performance information recorded by the player piano of the present embodiment is reproduced by the conventional player piano, it is possible to demonstrate "expected" performance of the conventional player piano maximally. In this sense, the player piano of the present embodiment has a compatibility with the conventional player piano.

When the performance information recorded by the player piano of the present embodiment is reproduced by the conventional player piano, the conventional player piano neglects the key-depression event as described above. However, the conventional player piano does not neglect interval data which precede or follow the key-depression event frame.

Suppose an example of performance data whose elements are arranged in an order of "string-striking event frame", "interval data 1", "key-depression event frame", "interval data 2", "key-release event frame", "interval data 3", . . . At reproduction of the above performance data, the player piano reads a set of the "string-striking event frame" and "interval data 1" at first, thereafter, the player piano reads a set of the "key-depression event frame" and "interval data 2" after elapse of time designated by the "interval data 1". In this case, the conventional player piano neglects the "key-depression event frame", however, it does not neglect the "interval data 2". Therefore, when a time designated by the "interval data 2" elapses after the reading of the "key-depression event frame" and "interval data 2", the player piano reads a set of the "key-release event frame" and "interval data 3".

As described above, when the performance information recorded by the player piano of the present embodiment is reproduced by the conventional player piano, the conventional player piano neglects the key-depression event, however, a time interval between the string-striking event and key-release event does not change.

(4) Fourth case where the performance information recorded by the player piano of the present embodiment is reproduced by the electronic musical instrument based on the MIDI standard.

The player piano of the present embodiment uses a byte of "90" as a status of a string-striking event. According to the MIDI standard, such a byte of "90" corresponds to a status of a note-on (event). In addition, a status of "80" of a key-release event corresponds to a status of a note-off (event) in the MIDI standard. Further, a status of "B0 50" of a key-depression event and a status of "B0 51" of extensional bytes are each defined as a general purpose controller in the MIDI standard. So, if the electronic musical instrument based on the MIDI standard is not designed to perform a special operation using the general purpose controller, it neglects the key-depression event and extensional bytes, so it is capable of reproducing the performance information.

In general, the electronic musical instrument based on the MIDI standard does not use a status as the general purpose controller. In addition, the general purpose controller used by the player piano of the present embodiment merely corresponds to a part of the general purpose controller defined by the MIDI standard. Therefore, almost all electronic musical instruments based on the MIDI standard are capable of reproducing the performance information recorded by the player piano of the present embodiment. In this sense, the player piano of the present embodiment has a compatibility with the electronic musical instrument based on the MIDI standard.

Like the aforementioned third case where the performance information recorded by the player piano of the present embodiment is reproduced by the conventional player piano, in the fourth case, the key-depression event is neglected but the interval data are not neglected. So, even if the performance information recorded by the player piano of the present embodiment is used for music performance of the electronic musical instrument based on the MIDI standard, a time interval between the string-striking event and key-release event does not change. In this sense, the player piano of the present embodiment has a compatibility with the electronic musical instrument based on the MIDI standard.

[F] Modification

The scope of this invention is not limited to the aforementioned embodiment, so it is possible to provide a variety of modifications to the embodiment, as follows:

(1) First modified example

In the aforementioned embodiment, the string-striking event is an event representing that the hammer strikes the string, so is information that sound is generated. Therefore, sound generation information representing that sound is generated can be detected by an operation that the hammer strikes the string as well. In addition, the key-release event is produced while the key returns from the end position to the rest position. In other words, the key-release event is information representing that sounding is stopped by making the damper in contact with the string. Therefore, sound stop information that sounding is stopped can be detected by an operation of the key which returns from the end position to the rest position. Incidentally, a decision as to whether sounding is stopped or not can be made by the detection of the operation of the key described above or by the detection of the position of the damper.

(2) Second modified example

The description of the aforementioned embodiment uses the string-striking event, key-depression event and key-release event as an example of events regarding the key motion. This invention is not limited to those events. So, it is possible to additionally provide irregular events representing a variety of variation-type performance techniques. In some case, for example, the player piano copes with a situation where after detection of a shut-off state of the upper photo-sensor SF2, a key-release operation is started under a condition that the lower photo-sensor SF3 is remained in a light-receiving state, so that the upper photo-sensor SF2 is placed in a light-receiving state. In such a situation, a key-depression event is not produced because the key does not pass the two photo-sensors. To clarify a lack of the key-depression event, it is possible to produce a key-depression lack event. Using such a key-depression lack event, it is possible to acknowledge that the key does not pass the lower photo-sensor SF3, so it is possible to reproduce an upper-multiple-hit performance technique that the key is subjected to multiple hits in proximity to the rest position.

When a new event is added to cope with the aforementioned variation-type performance technique, like the foregoing key-depression event, it is possible to use the general purpose controller defined by the MIDI standard as a status of the new event. Thus, it is possible to maintain the compatibility with the conventional player piano as well as the compatibility with the electronic musical instrument based on the MIDI standard. In addition, it is possible to reproduce a highly skilled performance technique.

(3) Third modified example

For simplification of the description, the aforementioned embodiment does not describe about the details of the performance data. However, a keycode KC representing the key on which the event occurs is added to performance data regarding the event(s) other than the interval data. At the recording mode, the events each accompanied with the keycode KC are recorded together with the interval data. At the reproduction mode, the key designated by the keycode KC is driven in accordance with the estimated trajectory.

As described heretofore, the effects of this invention are summarized as follows:

(i) It is possible to demonstrate the operation of the conventional player piano maximally in the case where the performance information recorded by the player piano of this invention is reproduced by the conventional player piano.

(ii) It is possible to reproduce a highly skilled performance technique in the case where the player piano of this invention reproduces the performance information recorded thereby.

(iii) It is possible to enlarge the resolution and dynamic range of the key velocity while maintaining the compatibility with the conventional player piano. So, it is possible to reproduce a tune with a delicate nuance.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A player piano comprising:

key-depression information creating means for detecting an event that a key is depressed so as to create key-depression information representative of a depressed state of the key;

string-striking information creating means for detecting an event that a hammer strikes a string so as to create string-striking information representative of a struck state of the string;

key-release information creating means for detecting an event that the depressed key is released so as to create key-release information representative of a released state of the depressed key; and performance information creating means for compiling the key-depression information, the string-striking information, and the key-release information, whereby all of which are collected together to form performance information for a keystroke to be played.

2. A player piano according to claim 1, further comprising:

velocity detecting means for detecting a depression velocity of a key, a string-striking velocity of a hammer action working together with the key, and a release velocity of the key in connection with a process that the key is depressed and then subsequently released;

data separation means for separating data representing at least one of the velocities detected by the velocity detecting means into high-order bits and low-order bits; and wherein said performance information further includes a first discrimination information designating a note-on or a note-off defined by a MIDI standard to the high-order bits so as to produce velocity information, a second discrimination information designating a general purpose controller by the MIDI standard to the low-order bits so as to produce extensional information, wherein the velocity information and the extensional information collectively form said performance information.

3. A player piano comprising:

velocity detecting means for detecting a velocity of a key, a velocity of a hammer action working together with the key and a velocity of a muting mechanism working together with the key in connection with a process that the key is depressed down and then is restored;

data separation means for separating data representing at least one of the velocities detected by the velocity detecting means into high-order bits and low-order bits; and performance information creating means for adding first discrimination information designating a note-on or a note-off defined by a MIDI standard to the high-order bits so as to produce velocity information and for adding second discrimination information designating a general purpose controller defined by the MIDI standard to the low-order bits so as to produce extensional information, so that the velocity information and the extensional information are collected to form performance information.

4. A player piano according to claim 3 wherein the performance information creating means outputs the extensional information just after the velocity information.

5. A player piano based on a MIDI standard comprising:

performance recording means for detecting a motion with respect to each of keys of the piano so as to provide recording information; and post-recording processing means for creating performance information based on said recording information, wherein said performance information includes key-depression information, string-striking information, and key-release with respect to each of the keys information.

6. A player piano according to claim 5 wherein said string-striking information represents a musical note and a string-striking velocity as well as extensional information for said string-striking velocity beyond that which is specifically defined by the MIDI standard, said key-release information represents said musical note and a key-release velocity as well as extensional information for said key-release velocity beyond that which is specifically defined by the MIDI standard, and said key-depression information represents said musical note and a key-depression velocity as well as extensional information for said key-depression velocity, all of which are beyond that specifically defined by the MIDI standard.

7. A player piano based on a MIDI standard comprising:

pre-reproduction processing means for producing trajectory data and position data from performance information supplied thereto, wherein said performance information includes key-depression information, string-striking information, and key-release information; and key motion control means for controlling a key motion using said trajectory data and said position data.

8. A player piano according to claim 7 wherein said trajectory data include:

a key-depression-uniform-motion trajectory, a key-depression-slow-down trajectory, a key-release-slow-up trajectory, and a key-release -uniform-motion trajectory, wherein for said key-depression-uniform-motion trajectory and said key-release-uniform-motion trajectory, a key moves at a constant velocity, and wherein velocity of said key slows down in said key-depression-slow-down trajectory and said key-release-slow-up trajectory, wherein said key-depression-slow-down trajectory and said key-release-slow-up trajectory cross each other when velocity of said key is zero.

* * * * *